US005277332A

United States Patent [19]

Rogers

[11] Patent Number: 5,277,332

[45] Date of Patent: Jan. 11, 1994

[54] MULTIPLE DISPENSING CONTAINER FOR VISCOUS MATERIALS, CUPS AND TOOTHPASTE

[76] Inventor: Isabel Rogers, 23 Manor Pkwy., Uniondale, N.Y. 11533

[21] Appl. No.: 13,687

[22] Filed: Feb. 4, 1993

[51] Int. Cl.[5] ..... B67D 5/60

[52] U.S. Cl. ..... 221/96; 222/100; 222/106; 222/132; 222/143; 222/181

[58] Field of Search ..... 222/93, 94, 99, 100, 222/105, 106, 129, 132, 143, 181, 192; 221/96, 310

[56] References Cited

U.S. PATENT DOCUMENTS

| | | | |
|---|---|---|---|
| 2,609,122 | 9/1952 | Stenerson | 222/93 X |
| 2,613,853 | 10/1952 | Halvorsen | 222/93 X |
| 2,760,681 | 8/1956 | Arquelles et al. | 222/100 X |
| 2,781,152 | 2/1957 | Van Slyke | 222/181 X |
| 2,971,678 | 2/1961 | Cazeneuve | 222/181 X |
| 3,078,016 | 2/1963 | Judy | 222/181 |
| 3,198,389 | 8/1965 | Dunning | 222/93 |
| 3,232,488 | 2/1966 | Headberg | 222/101 |
| 3,331,533 | 7/1967 | Krugger | 221/96 |
| 3,434,629 | 3/1969 | Hooge et al. | 221/96 X |
| 3,720,352 | 3/1973 | Kozlowski | 222/132 |
| 3,955,715 | 5/1976 | Toper | 222/181 X |
| 3,987,932 | 10/1976 | Maldon | 221/96 |
| 4,039,104 | 8/1977 | Mijares, Jr. et al. | 222/181 X |
| 4,874,113 | 10/1989 | Schmidt | 222/143 |
| 4,880,145 | 11/1989 | McManus | 222/181 X |
| 4,998,647 | 3/1991 | Sharp | 222/181 X |
| 5,044,522 | 9/1991 | Roig et al. | 222/181 X |
| 5,183,182 | 2/1993 | Comstock et al. | 222/181 X |

*Primary Examiner*—Kevin P. Shaver
*Attorney, Agent, or Firm*—Collard & Roe

[57] ABSTRACT

A bathroom dispenser for containing and dispensing health-related products, cups and toothpaste from a tube, including several longitudinally-extending containers each having a bottom end, an open top end for receiving the health-related product and dispensing means at the bottom end for dispensing the health related product. The dispenser also includes a longitudinally-extending cup dispenser disposed adjacent to the containers and having a bottom end, an open top end for receiving cups and flexible retaining means at the bottom end for singly dispensing the cups. The dispenser also includes a longitudinally-extending toothpaste dispenser disposed adjacent to the containers for receiving a tube of toothpaste having a flat crimped end and a threaded open end. The toothpaste dispenser has a bottom with an aperture and an open top end for receiving the tube of toothpaste so that the threaded open end extends through the aperture. The toothpaste dispenser engages the flat crimped end of the tube and is guided toward the aperture to gradually flatten the tube and dispense the toothpaste.

9 Claims, 3 Drawing Sheets

MULTIPLE DISPENSING CONTAINER FOR VISCOUS MATERIALS, CUPS AND TOOTHPASTE

BACKGROUND OF THE INVENTION

1. Field of the Invention

The present invention relates to a bathroom dispenser which is suitable for gravity distribution of liquid solutions or granular materials. More specifically, it relates to a bathroom dispenser having several liquid or granular dispensers, with a cup dispenser and a toothpaste dispenser on each end thereof.

2. The Prior Art

Containers and dispenser are known for various uses in the home. Various containers and dispensers are discloses, for example, in U.S. Pat. No. 2,971,678, to Cazeneuve; U.S. Pat. No. 2,781,152, to Van Slyke; and U.S. Pat. No. 3,078,016, to Judy. These patents disclose several liquid or granular material dispensers which are arranged adjacent to each other for mounting on a bathroom wall, for example.

U.S. Pat. No. 3,232,488, to Headberg, discloses an electro-mechanical dispenser for toothpaste. It would be desirable to have a dispenser with interchangeable units which would allow the user to select the dispensers most suitable to their needs. In addition, interchangeable dispensers could be easily removed from the main unit for refilling, cleaning or replacement, if damaged. Previously, a dispenser has not been available which provides several dispensers in conjunction with a paper cup dispenser and a manual toothpaste dispenser.

SUMMARY OF THE INVENTION

It is the purpose of the invention to provide a bathroom dispenser which overcomes the deficiencies of the prior art and provides a mixed array of dispensers in a single unit.

It is a further object of the present invention to provide a bathroom dispenser which has interchangeable dispenser units for simple refilling or replacement.

It is yet another object of the present invention to provide a bathroom dispenser having several liquid dispensers, a paper cup dispenser and a manual toothpaste dispenser.

These and other related objects are achieved according to the invention by a bathroom dispenser for containing and dispensing health related products, cups and toothpaste from a tube. The dispenser includes several longitudinally extending containers, each having a bottom end and open top end for receiving a health related product and dispensing means at said bottom end for dispensing the health related product. The dispenser also includes a longitudinally extending cup dispenser disposed adjacent to the containers and having a bottom end and open top end for receiving cups and flexible retaining means at said bottom end for singly dispensing the cups. The dispenser also includes longitudinally extending toothpaste dispensing means disposed adjacent to the containers for receiving a tube of toothpaste having a flap, crimped end and a threaded open end. The toothpaste dispensing means has a bottom with an aperture and an open top end for receiving the tube of toothpaste so that its threaded open end extends through the aperture. The toothpaste dispensing means engages the flat, crimped end of the tube and is guided toward the aperture to gradually flatten the tube and dispense the toothpaste.

The toothpaste dispensing means includes a first side wall, a second side wall and key retaining means, including a retaining channel disposed within said first side wall and extending to the open top end and an open slot disposed within said second side wall extending to the open top end of said toothpaste dispensing means. The toothpaste dispensing means additionally includes a key having a first end, a second end and a central axis coupled between the first end and the second end. The first end is retained within the retaining channel, with the central axis extending from the retaining channel across the toothpaste dispensing means and through the open slot.

In an alternate embodiment, the bathroom dispenser includes a baseplate and a cover pivotally connected to the baseplate. The several containers, the cup dispenser and the toothpaste dispensing means are attached to the baseplate, with the cover being movable from an open position exposing the top ends for refilling the containers. The cup dispenser and the toothpaste dispensing means include a closed position for covering the containers, the dispenser and the toothpaste dispensing means. The base plate includes a male/female connector, and the several containers, cup dispenser and toothpaste dispensing means each includes a cooperatively shaped female/male connector for removably connecting the several containers, the cup dispenser and toothpaste dispensing means to the baseplate.

In a further embodiment, a multiple dispensing container arrangement is disclosed for containing and dispensing liquid and granular materials, cups and toothpaste from a tube. The multiple dispensing container arrangement includes, in combination, an attachable base support serving as a stationary wall mount having a top edge and a front surface. A hinged lid is coupled to the top edge, and mounting means are located on the front surface accessible from the edge. The hinged lid is movable between an open position, in which the lid is parallel with the front surface, and a closed position, in which the lid is generally aligned transverse to the front surface. A plurality of dispensers, including a cup dispenser, a mechanical toothpaste tube dispenser and several liquid and granular material dispensers are provided. Each dispenser has a back side, a lower end, dispensing means disposed at the lower end and support means located on the back side configured and dimensioned to slidingly engage the mounting means from the top edge. In the open position, the hinged lid provides access to the mounting means and the dispensers for sliding the support means into and out of engagement with the mounting means and for refilling the dispensers with liquid and granular materials, cups and tubes of toothpaste. In the closed position, the hinged lid prevents access to the mounting means and covers the dispensers.

BRIEF DESCRIPTION OF THE DRAWINGS

Other objects and features of the present invention will become apparent from the following detailed description considered in connection with the accompanying drawings which discloses an embodiment of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 1:
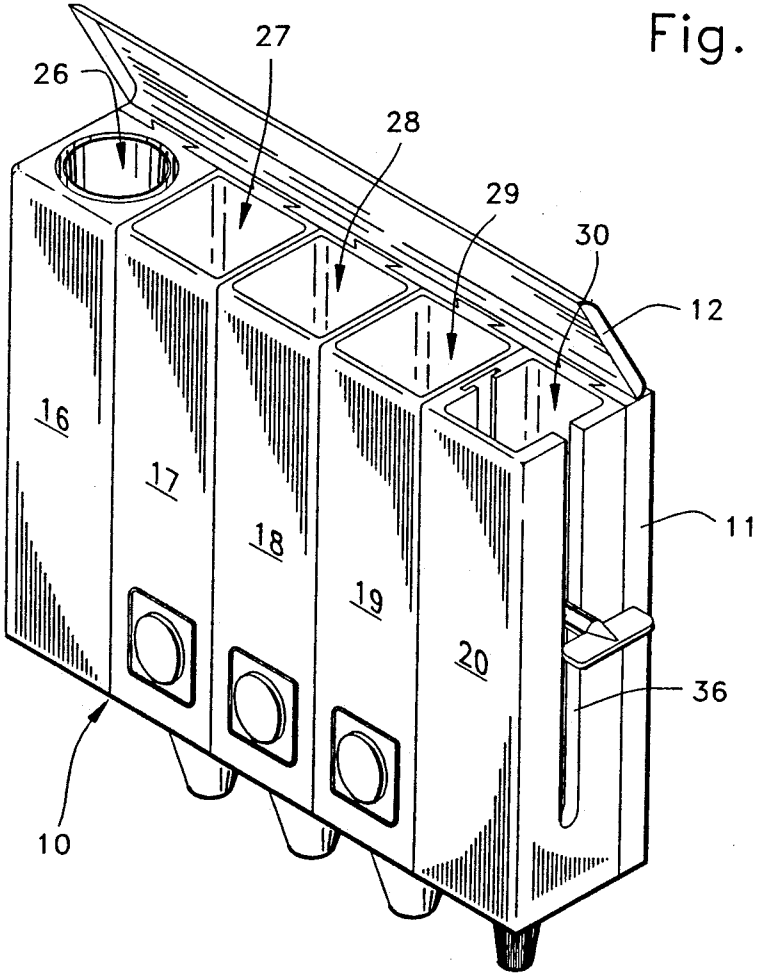
FIG. 1 is a perspective view of the bathroom dispenser with the lid partially open.

Referring now in detail to the drawings and in particular FIG. 1, there is shown a bathroom dispenser 10, having a rear panel 11 and a hinged lid 12. Lid 12 covers the tops of containers 16, 17, 18, 19 and 20 to prevent dust or other foreign particles from contaminating the contents of the containers.

Figure 5:
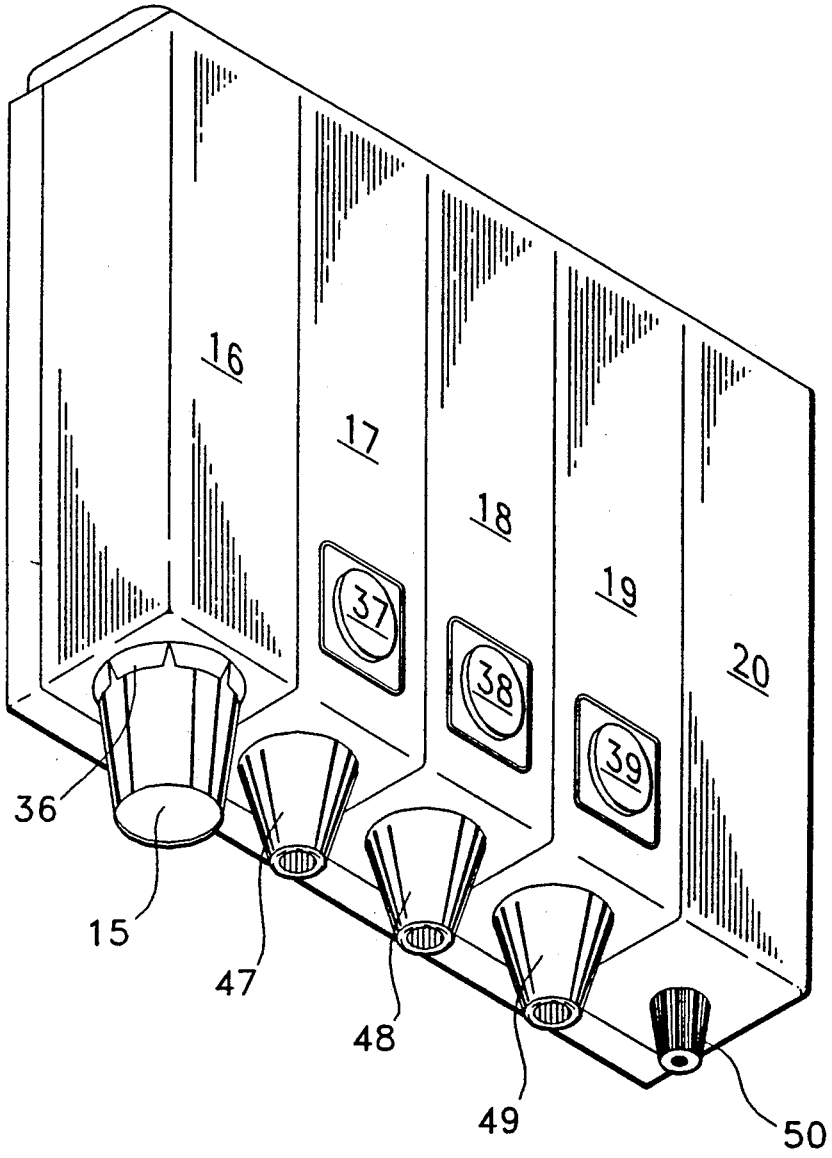
FIG. 5. is a perspective view showing the bottom portion of the dispenser.

Container 16 is, for example, a paper cup dispenser having a cylindrical opening 26, extending through the entire height of container 16. As can be seen in FIG. 5, the bottom or dispensing end of container 16 is provided with a flexible retaining ring 36 made of rubber, for example. Retaining ring 36 has an inner diameter slightly smaller than cylindrical opening 26 and is designed to flexibly retain the upper portion of paper cup 15, just below its rim. Paper cup 15 is released by grasping and pulling paper cup 15 downward, so that retaining ring 36 flexes to allow the rim of paper cup 15 to pass therethrough.

Figure 3:
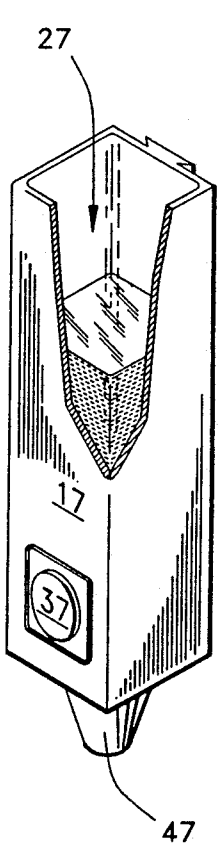
FIG. 3 is a perspective view in part cross-section showing one of the liquid dispensers.

Referring to FIG. 1, containers 17, 18 and 19 include a square cross-sectional opening designated as openings 27, 28 and 29 respectively. As can be seen in FIG. 5, each container 17, 18 and 19 is equipped with dispensing means consisting of a push button 37, 38 and 39, respectively, and a nozzle 47, 48 and 49 respectively. The various push buttons may simply open a valve within the nozzle in the case of a liquid such as mouthwash, or may pump the contents of the container through the nozzles in the case of a viscous material, such as hand lotion or shaving cream. The dispensing means on containers 17, 18 and 19 may all be similar, for example, low viscosity dispensing means, or they may be mixed to provide the ability to dispense both low and high viscosity liquids. FIG. 3 shows container 17, for example, with a liquid within opening 27. Push button 37 opens a valve within nozzle 47 and the low viscosity liquid, for example, mouthwash flows through nozzle 47 under the influence of gravity. As can be appreciated, a liquid with a high viscosity may not flow through an open valve solely under the influence of gravity. If container 17 was instead filled with a highly viscous hand lotion, for example, push button 37 would pump the contents through nozzle 47.

Figure 2A:
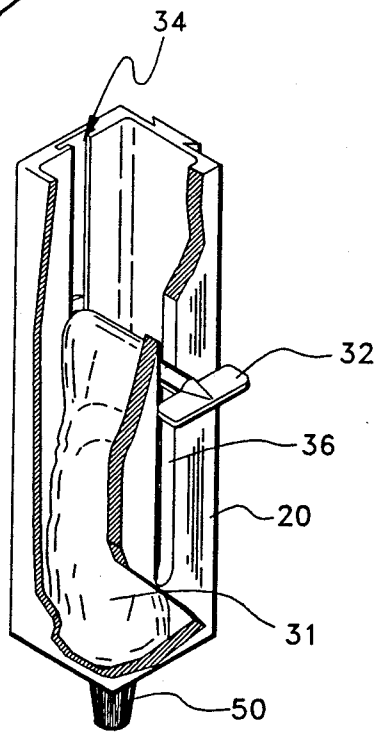
FIG. 2*a* is a perspective view in part cross-section showing the toothpaste dispenser.
Figure 2B:
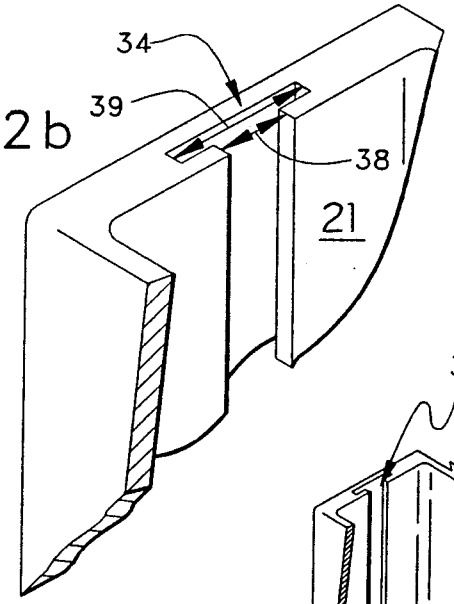
FIG. 2*b* is an enlarged perspective view of the upper edge of the toothpaste dispenser from FIG. 2*a*.
Figure 4:
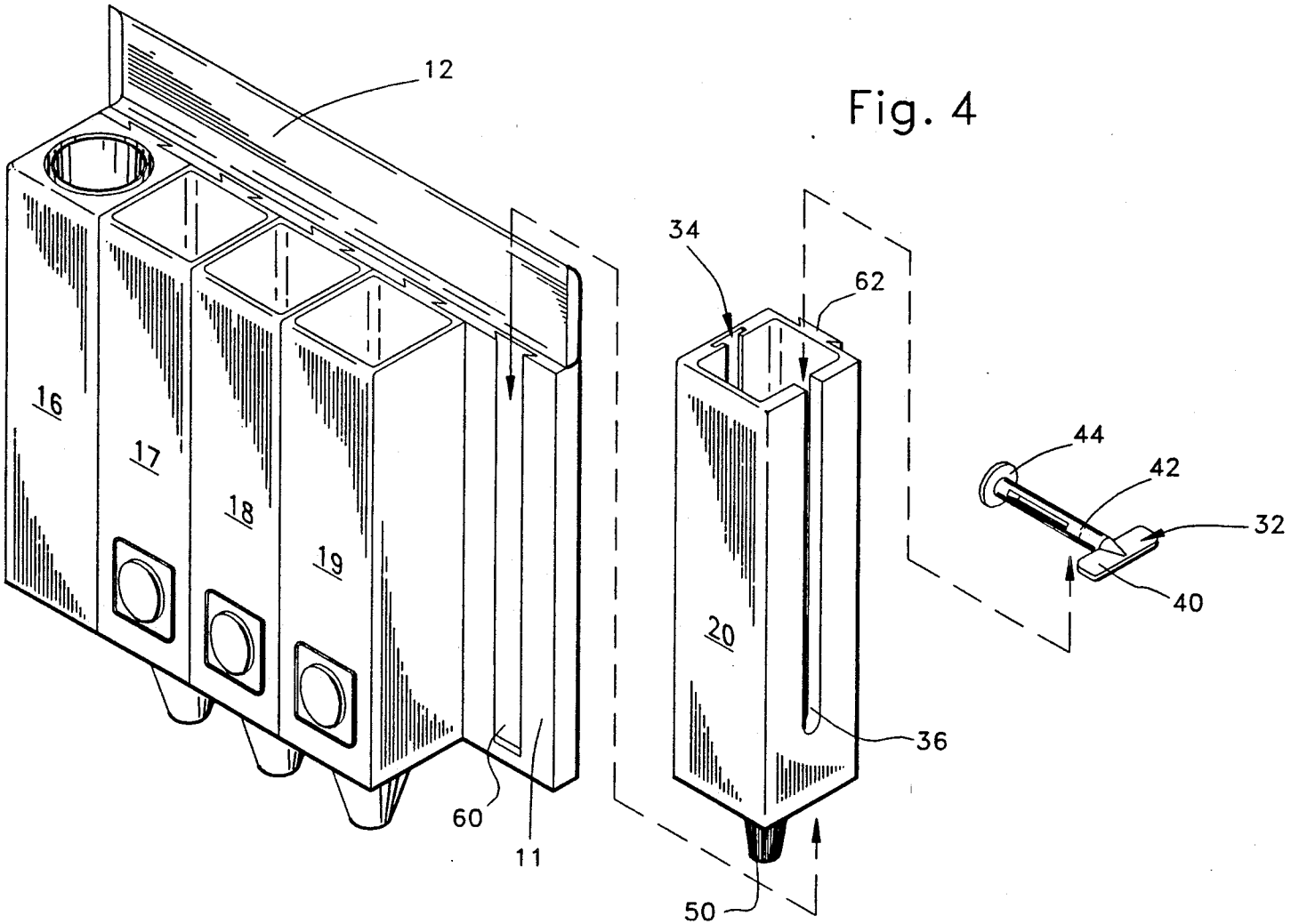
FIG. 4. is an exploded view showing the toothpaste dispenser and the key.

FIGS. 1, 2*a* and 2*b* show container 20 in the form of a mechanical toothpaste dispenser. Toothpaste dispenser 20 includes a square cross-sectional opening 30 and is equipped with a key 32, a T-shaped retaining channel 34 and an open slot 36. As can be seen in FIG. 4, key 32 includes a flat handle 40 and a slotted bar 42 connecting handle 40 to a disc 44. T-shaped retaining channel 34 is located within the inner side wall 21 of container 20. T-shaped retaining channel 34 has a narrow section 38 connecting square cross-sectional opening 30 to a wider section 39. Sections 38 and 39 are configured and dimensioned so that disc 44 fits within section 39 with slotted bar 42 projecting through section 38, across square cross-sectional opening 30 and through slot 36. Handle 40, which is located on the end of slotted bar 42, is located exteriorly of container 20. Section 39 is slightly wider than the diameter of disc 44 and section 38 and slot 36 are slightly wider than the diameter of slotted bar 42, so that key 32 can freely rotate and move vertically along the height of container 20.

As can be seen in FIGS. 2*a*, 4 and 5, a cap 50 is provided to engage the threaded end of the toothpaste tube 31. Cap 50 is similar to the cap which is placed on a tube of toothpaste for commercial sale. However, cap 50 is hollow, allowing the toothpaste to pass therethrough. When toothpaste dispenser 20 needs to be refilled, the cap from a new tube of toothpaste is removed key 32 is attached to the flat crimped end of tube 31, and tube 31 is placed into container 20 so that the threaded open end of tube 31 passes through the bottom of container 20. Cap 50 is then threaded onto the open end of tube 31 to secure tube 31 to toothpaste dispenser 20. This will prevent tube 31 from moving upwardly into toothpaste dispenser 20 when key 32 is rotated. As can be appreciated, if tube 31 moves up into toothpaste dispenser 20, then toothpaste may be dispensed within toothpaste dispenser 20 and not on the intended toothbrush.

Alternatively, cap 50, may be the cap which accompanied tube 31 originally. Cap 50 would then simply be used to keep dust or dirt from contaminating the toothpaste. Cap 50 could simply be removed briefly to dispense toothpaste and then be replaced. Under these circumstances, key 32 would have to be carefully rotated in order to insure that tube 31 does not move upwardly into toothpaste dispenser 20. Alternatively, cap 50 may be the cap originally provided with the tube of toothpaste and could be provided with a small slit or opening by the user, to both protect the toothpaste from contaminants and prevent tube 31 from moving upwardly within dispenser 20.

As can be seen in FIG. 4, rear panel 11 is provided with a plurality of grooves which have the shape of a trapezoid, for example. Containers 16–20 are each provided with a cooperatively shaped tongue 62, which also is shaped as a trapezoid, for example. Groove 60 extends from the top of rear panel 11 along the height of rear panel 11. However, groove 60 terminates above the bottom of rear panel 11 forming a support for the container. Similarly, tongue 62 extends from the top end of the container along the height of the container and terminates above the bottom edge of the container. Tongue 62 of container 20 ca be slid into and out of groove 60 simply by opening hinged lid 12 and aligning the bottom of tongue 62 with the top of groove 60. It is to be understood that the tongue and groove connection may be formed in many different shapes as long as the containers are retained on rear panel 11.

Each container can be slid onto or off of rear panel 11 allowing the user to replace damaged containers, occasionally clean the containers, or substitute different kind of containers. It is also possible to remove container 16 or 20, for example, and substitute a pair of containers which would extend to the left of rear panel 11. For example, container 16 could be replaced by another unit which includes a cup dispenser and a Q-tip holder or toothbrush holder, extending off to the left of rear panel 11. A Q-tip holder or toothbrush holder would ordinarily require an open top and therefor would not be affected by the fact that hinge lid 12 does not extend over it.

Rear panel 11 of the bathroom dispenser can be easily mounted to a wall surface by a double-sided adhesive tape or screws, for example. Once rear panel 11 is mounted, the individual container 16–20 could be mounted onto rear panel 11. Container 16 could then be filled with paper cups, container 17–19 could be filled with various health related products, and a tube of toothpaste could be loaded into toothpaste dispenser 20. As can be appreciated, once container 16–20 are filled, the packages which the various health related items were sold in could be moved off of the bathroom counter and placed underneath the sink, for example. Thus, the sink and countertop area could be cleared of the numerous bottles and packages, etcetera, which are ordinarily found there. In addition, consumers could buy one gallon containers of liquid soap, mouthwash, etcetera which ordinarily would be inconvenient to use. The products contained within the one gallon container could then be used to refill container 17–19. Purchasing larger volumes of products usually results in a lower price per unit, as well as a savings of material required to package the goods. The middle container 17, 18 and 19 could be provided with small labels or stickers to indicate which product is contained therein.

While only a single embodiment of the present invention has been shown and described, it is to be understood that many changes and modifications may be made thereunto without departing from the spirit and scope of the invention as defined in the appended claims.

What is claimed is:

1. A multiple dispensing container arrangement for containing and dispensing liquid and granular materials, cups and toothpaste from a tube, comprising, in combination:

an attachable base support serving as a stationary wall mounting having a top edge, a hinged lid coupled to said top edge and a front surface including mounting means accessible from said top edge, said hinged lid being movable between an open position, in which said lid is parallel with said front surface, and a closed position, in which said lid is generally aligned transverse to said front surface; and a plurality of dispensers, including a cup dispenser, a mechanical toothpaste tube dispenser and several liquid and granular material dispensers, each dispenser having a back side, a lower end, dispensing means disposed at said lower end and support means located on said back side configured and dimensioned to slidingly engage said mounting means from said top edge so that, in the open position, said hinged lid providing access to said mounting means and said dispensers for sliding said support means into and out of engagement with said mounting means and for refilling said dispensers with liquid and granular materials, cups and tubes of toothpaste, and in the closed position, said hinged lid preventing access to said mounting means and covers said dispensers.

2. A bathroom dispenser for containing and dispensing health-related products, cups and toothpaste from a tube comprising:

several longitudinally extending containers each having a bottom end, an open top end for receiving a health-related product and dispensing means at said bottom end for dispensing the health-related product;

a longitudinally extending cup dispenser disposed adjacent to said containers and having a bottom end, an open top end for receiving cups and flexible retaining means at said bottom end for singly dispensing the cups;

longitudinally extending toothpaste dispensing means disposed adjacent to said containers for receiving a tube of toothpaste having a flat crimped end and a threaded open end, said toothpaste dispensing means having a bottom with an aperture and an open top end for receiving the tube of toothpaste so that is threaded open end extends through the aperture, said toothpaste dispensing means including means engaging the flat crimped end of said tube for gradually flattening the tube and dispensing the toothpaste and means for guiding the means which engages the flat crimped end toward the aperture; and a base plate and a cover pivotally connected to said base plate; said several containers, said cup dispenser and said toothpaste dispensing means being attached to said base plate, with said cover being movable between an open position exposing said open top ends for refilling said containers, said cup dispenser and said toothpaste dispensing means, and a closed position for covering said several containers, said cup dispenser and said toothpaste dispensing means.

3. A bathroom dispenser for containing and dispensing health-related products, cups and toothpaste from a tube comprising:

several longitudinally extending containers each having a bottom end, an open top end for receiving a health-related product and dispensing means at said bottom end for dispensing the health-related product;

a longitudinally extending cup dispenser disposed adjacent to said containers and having a bottom end, an open top end for receiving cups and flexible retaining means at said bottom end for singly dispensing the cups; and longitudinally extending toothpaste dispensing means disposed adjacent to said containers for receiving a tube of toothpaste having a flat crimped end and a threaded open end, said toothpaste dispensing means having a bottom with an aperture and an open top end for receiving the tube of toothpaste so that its threaded open end extends through the aperture, said toothpaste dispensing means including key means which engages the flat crimped end of said tube for gradually flattening the tube and dispensing the toothpaste and retaining means for guiding the key means toward the aperture;

said toothpaste dispensing means including a first side wall, a second side wall, and said retaining means including a retaining channel disposed within said first side wall and extending to the open top end, and an open slot disposed within said second side wall extending to the open top end of said toothpaste dispensing means;

said key means including a key having a first end, a second end and a central axle coupled between said first end and said second end, said first end being larger than said central axle and retained within said retaining channel, with said central axle extending from said retaining channel across said toothpaste dispensing means and through the open slot;

said second side wall including an inside surface facing said first side wall and an outside surface, said second end of said key being formed as a handle disposed adjacent to said outside surface;

said first side wall including an inside surface facing the inside surface of said second side wall, the retaining channel including a first section having a width slightly larger than the diameter of said central axle and smaller than said first end of said key located adjacent the inside surface of said first side wall;

the retaining channel having a second section with a width slightly larger than the first end of said key, said second section being connected to said first section, so that said first end of said key is retained within said second section with said central axle passing through said first section;

wherein the open slot has a width slightly larger than the diameter of said central axle, so that said central axle extends through the open slot; and wherein the bathroom dispenser additionally includes a base plate and a cover pivotally connected to said base plate; said several containers, said cup dispenser and said toothpaste dispensing means being attached to said base plate, with said cover being movable between an open position exposing said open top ends for refilling said containers, said cup dispenser and said toothpaste dispensing means, and a closed position for covering said several containers, said cup dispenser and said toothpaste dispensing means.

4. The bathroom dispenser according to claim 3, wherein at least one of said several containers includes a valve for dispensing a health-related product having a low viscosity by gravity.

5. The bathroom dispenser according to claim 3, wherein at least one of said several containers includes pump means for dispensing a health-related product having a high viscosity.

6. The bathroom dispenser according to claim 5, wherein said base plate includes a female connector and said several containers, said cup dispenser and said toothpaste dispensing means each includes a cooperatively shaped male connector for removably connecting said several containers, said cup dispenser and said toothpaste dispensing means to said base plate.

7. The bathroom dispenser according to claim 6, wherein said female connector is a groove and said male connector is a tongue, cooperatively shaped to fit within said groove.

8. The bathroom dispenser according to claim 7, wherein the bathroom dispenser additionally includes a threaded cap having a hollow interior for engaging the threaded open end of a tube of toothpaste following its placement through the aperture of said toothpaste dispensing means for retaining said tube in position during rotation of said key.

9. The bathroom dispenser according to claim 8, wherein said central axle includes a slot extending therethrough, the slot being configured and dimensioned to receive the flat crimped end of the tube of toothpaste and frictionally retain the flat crimped end during rotation of said key.

* * * * *